US008579673B1

(12) United States Patent
Monk

(10) Patent No.: US 8,579,673 B1
(45) Date of Patent: Nov. 12, 2013

(54) CONVERTIBLE STARTING GATE FOR RACING TRACK

(76) Inventor: Steven Monk, Forest City, IA (US)

( * ) Notice: Subject to any disclaimer, the term of this patent is extended or adjusted under 35 U.S.C. 154(b) by 431 days.

(21) Appl. No.: 12/910,043

(22) Filed: Oct. 22, 2010

Related U.S. Application Data

(60) Provisional application No. 61/311,303, filed on Mar. 6, 2010.

(51) Int. Cl.
*A63H 29/00* (2006.01)
*A63H 18/00* (2006.01)

(52) U.S. Cl.
USPC ..... 446/429; 446/444

(58) Field of Classification Search
USPC ..... 446/444, 429; 238/10 E, 10 R; 463/58, 463/69
See application file for complete search history.

(56) References Cited

U.S. PATENT DOCUMENTS 2,736,556 A * 2/1956 Dasher ..... 463/69
3,502,332 A * 3/1970 Tobin ..... 463/69
3,658,333 A * 4/1972 Carcel ..... 463/69
4,541,813 A * 9/1985 Ikeda ..... 446/424
7,241,223 B1 * 7/2007 Caudill ..... 463/62
7,285,035 B1 * 10/2007 Tullis ..... 446/444
7,651,398 B2 * 1/2010 Ostendorff et al. ..... 463/60
8,016,639 B2 * 9/2011 Jobe ..... 446/429
8,043,139 B2 * 10/2011 Jobe ..... 446/429

FOREIGN PATENT DOCUMENTS

GB 2228208 A * 8/1990

* cited by examiner

*Primary Examiner* — Gene Kim
*Assistant Examiner* — Alyssa Hylinski
(74) *Attorney, Agent, or Firm* — Dicke, Billig & Czaja, PLLC

(57) ABSTRACT

A race track including a first racing lane, a second racing lane, a first starting mechanism, a second starting mechanism and a linking mechanism. The first starting mechanism is operably mounted to the first racing lane. The second starting mechanism is operably mounted to the second racing lane. The linking mechanism is capable of selectively attaching to the first starting mechanism and the second starting mechanism. The first starting mechanism and the second starting mechanism are independently operable unless the linking mechanism is attached to the first starting mechanism and the second starting mechanism which causes the first starting mechanism and the second starting mechanism to move in unison.

12 Claims, 2 Drawing Sheets

CONVERTIBLE STARTING GATE FOR RACING TRACK

REFERENCE TO RELATED APPLICATION

This application claims priority to U.S. Provisional Application No. 61/311,303, which was filed on Mar. 6, 2010, the contents of which are incorporated herein by reference.

FIELD OF THE INVENTION

The invention relates generally to race tracks on which toy cars are used. More particularly, the invention relates to starting gates for race tracks on which toy cars are used.

BACKGROUND OF THE INVENTION

For some time toy cars have been raced against each other to see which toy car is the fastest. In certain settings, the toy cars are placed on adjacent tracks, which enable the toy cars to simultaneously race against each other.

One such organized toy car racing competition is called the pinewood derby, which is typically participated in by youth such as through Cub Scouts or church groups. Person participating in these races design and then build their own cars that are thereafter used in the racing competition.

Each of the toy cars must weigh no more than five ounces and have several other characteristics that are set forth in the pinewood derby rules. The race cars are each formed by carving a block of wood into a desired shape and then the wheels are attached thereto. In some instances, weights may be added to the race car to get the weight as close as possible to five ounces.

The track used in conjunction with the pinewood derby races generally has between 2 and 8 lanes. The race track generally has a length of between about 32 feet and 50 feet. In some cases, the tracks are formed by cutting sheets of plywood into one foot wide strips and then attaching lath strips to guide the toy race cars. The race tracks have also been made from metallic and plastic materials, which enhance the durability of the race track.

One end of the race track is supported in an elevated position such that the race track slopes downwardly from a start end to a finish end so that gravity causes the race cars to move along the track. A starting gate located at the start end of the race track is moveable between a closed position for maintaining the race cars at the start end of the race track and an open position for allowing the race cars to travel toward the finish end of the race track. An electronic timer may also be located at the finish end of the race track to accurately determine the winner of a particular race.

SUMMARY OF THE INVENTION

An embodiment of the invention is directed to a convertible starting gate for a race track that is used in conjunction with toy race cars. The convertible starting gate allows multiple lanes on the race track to either be controlled as a single unit or controlled individually.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

Figure 1:
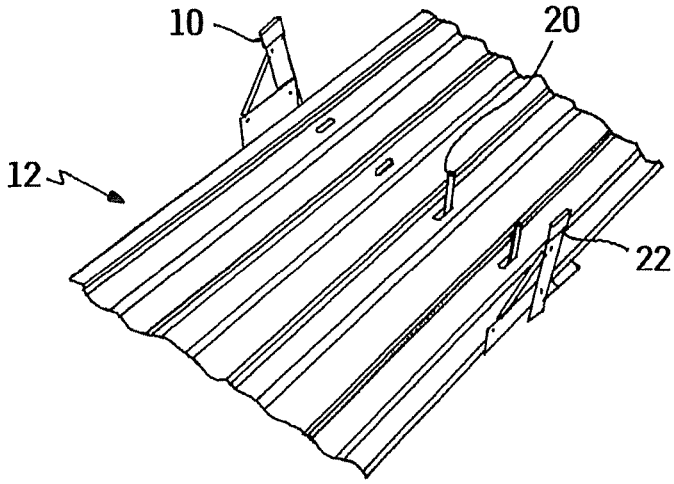
FIG. 1 is an upper perspective view of a racing track on which the convertible split starting gate may be used.

Race tracks are often used in conjunction with toy race cars because the race tracks guide the race cars between a starting location and an ending location. When it is desired to simultaneously race multiple race cars, the race track may be formed with multiple lanes that are oriented in a parallel relationship, as illustrated in FIG. 1.

The lanes may each have a base surface over which the race car may roll. The lanes may also include at least one divider that extends above the base surface. The dividers are oriented in a spaced-apart configuration so that a spacing between adjacent dividers is slightly wider than a width of the race car. The dividers thereby direct the race cars in a straight direction along the race track.

The race tracks may be fabricated from a variety of materials using the concepts of the invention. Two such materials that are typically used for fabricating the race track are wood and aluminum. While the wood race tracks are generally less expensive, the aluminum race tracks are generally more durable and weigh less.

While it is possible for persons to hold the race car and then release the race car when it is desired to start the race, it is customary to utilize a starting mechanism that engages the race car to retain the race car at a starting position until it is time for the race to start. Thereafter, the starting mechanism releases, which allows the race car to begin it movement along the race track.

There are two general types of starting mechanisms. A first type of starting mechanism engages all of the race cars at the same time. Releasing of the starting mechanism causes all of the race cars to be released at the same time. This type of starting mechanism removes the response time of the individual persons who are racing their race cars because all of the race cars are released at the same time.

A second type of starting mechanism has separate activation mechanisms for each of the lanes on the race track. When a signal is given to start the race, each of the individuals must release the starting mechanism that is associated with their individual race car. This type of starting mechanism thereby causes the response time of the individual persons to play a role in which race car wins the race because the person with the quickest reaction to the start signal will release the starting mechanism first.

Figure 2:
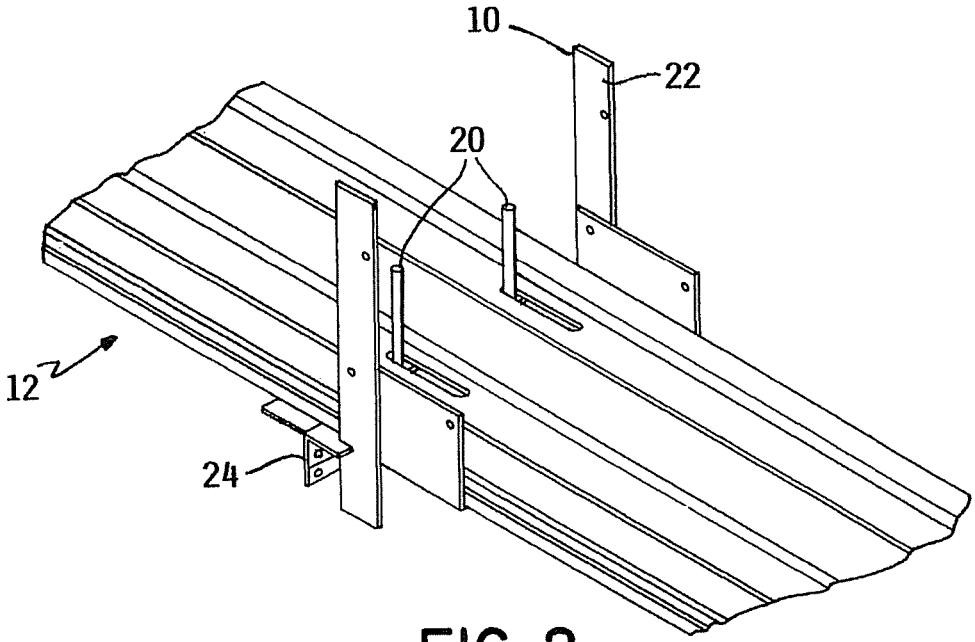
FIG. 2 is an enlarged upper perspective view of the starting gate.

The starting mechanism 10 is mounted proximate a proximal end of the race track 12 as illustrated in FIGS. 1 and 2. The placement of the starting mechanism 10 on the race track 12 thereby allows a race car (not shown) to be positioned on the race track 12 behind the starting mechanism 10.

The starting mechanism 10 generally includes a start pin 20 and a start lever 22 that are mounted with respect to the race track 12, as illustrated in FIG. 2. The start lever 22 is operably attached to the start pin 20 such that movement of the start lever 22 causes movement of the start pin 20.

The start pin 20 is formed with a length that is sufficiently long so that the start pin 20 extends at least partially in front of the race car when the race car is in the starting position and the start pin 20 is in a stop orientation. The start pin 20 thereby retains the race car in the starting position.

The start pin 20 is movable to a start orientation that permits the race car to begin moving along the race track 12 towards a distal end thereof. When in the start orientation, the start pin 20 may be substantially below an upper surface of the race track base surface 30.

The start lever 22 is utilized to move the start pin 20 between the stop orientation and the start orientation. The start lever 22 may be formed with a length and a width that facilitates a person gripping the start lever 22 with one of the person's hands. In certain embodiments, the start lever 22 is formed with a length of about 6 inches.

When in the stop orientation, the start lever 22 may extend above an upper surface of the race track 12 to remind persons using the race track that the starting mechanism 10 is in the stop orientation.

The start pin 20 may be biased to the start orientation. The start lever 22 may be rotated to urge the start pin 20 to the stop orientation. When the force is removed from the start lever 22, the bias force causes the start pin 20 to rotate to the start orientation. Using this configuration enhances the ability of the convertible start gate to have repeatable starts.

A start base 24 may be used to operably attach the start lever 22 to the start pin 20 as well as to operably attach the starting mechanism 10 to the race track 12. The start base 24 may include at least a first base portion 30 and a second base portion 32 that are pivotally attached to each other.

The first base portion 30 may be attached to the race track 12 using a variety of techniques. One such suitable attachment technique is a bolt that engages a lower surface of the race track 12. An important aspect of attaching the first base portion 30 to the race track 12 is that the first base portion 30 remains substantially stationary with respect to the race track 12.

When the first base portion 30 is attached to the race track 12, the first base portion 30 should be oriented substantially transverse to an orientation of the race track 12 so that each of the race cars will be substantially aligned with each other when starting the race.

The start pin 20 may be operably attached to the second base portion 32. An end of the start lever 22 may be adjacent to the second base portion 32. Rotation of the start lever 22 causes the start lever 22 to engage the second base portion to thereby retain the start pin 20 in the stop orientation.

It is possible for other connection mechanisms between the start lever 22 and the start pin 20 to be utilized. An example of one such alternative connection mechanism is at least one gear. A person of skill in the art will appreciate that utilizing the at least one gear would enable the start pin 20 to move at a different rate than the start lever 22. Depending on the configuration of the least one gear, the start pin 20 may move slower or faster than the start lever 22.

Figure 3:
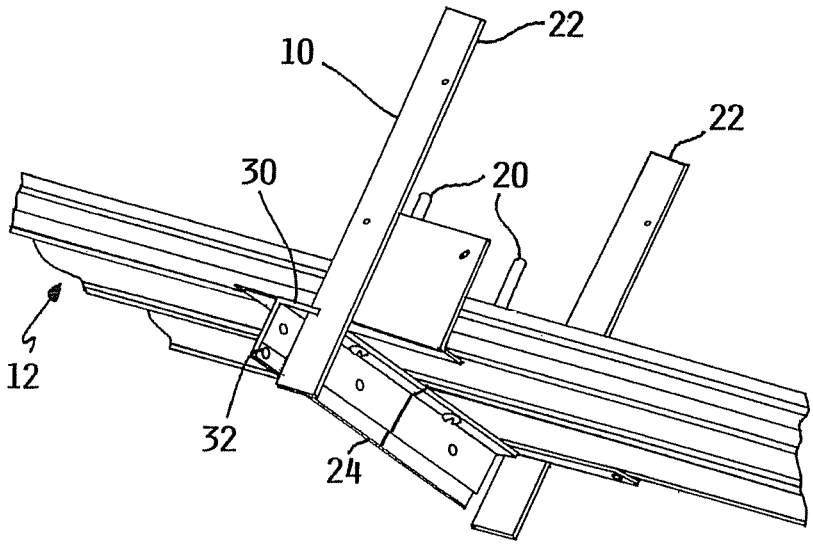
FIG. 3 is a lower perspective view of the starting gate in a first configuration.
Figure 4:
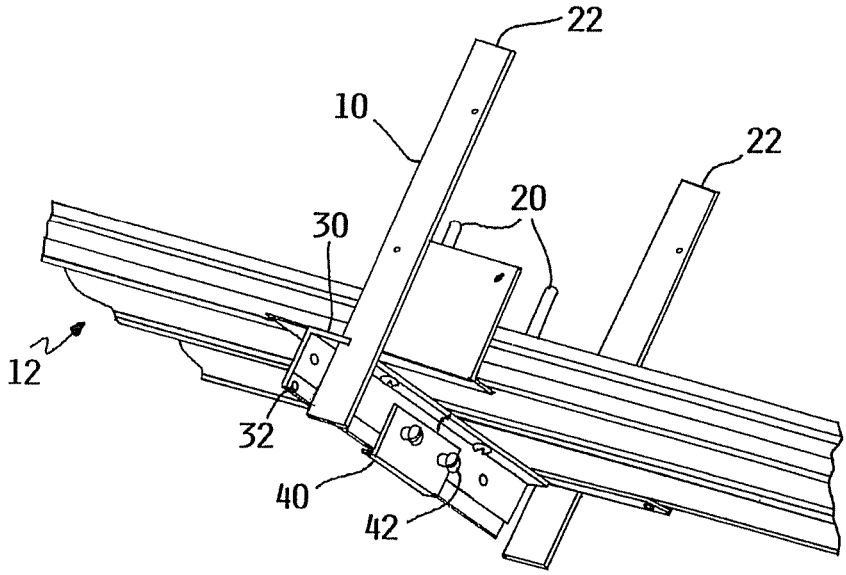
FIG. 4 is a lower perspective view of the starting gate in a second configuration.

The starting mechanism 10 may also include a connection mechanism 40 such as is illustrated in FIGS. 3 and 4. The connection mechanism 40 operably connects the second base portion 32 on adjacent starting mechanisms 10. The connection mechanism 40 thereby enables the starting mechanisms 10 to be converted from being independently operable such as in a split start configuration to being simultaneously operable.

The connection mechanism 40 may engage the second base portion 32 in a variety of ways using the concepts of the invention. One such way is for the connection mechanism 40 to have a U-shaped configuration so that the connection mechanism 40 extends over the second base portions 32 on the adjacent starting mechanism 10.

A fastener 42 may extend through an aperture on the connection mechanism 40 and then engage a surface of the second base portion 32 to thereby retain the connection mechanism 40 in a stationary portion with respect to the second base portion 32. In certain embodiments, the fastener 42 is a screw. The screw may have an enlarged head that enables the screw to be manually turned without the use of an external mechanism such as a screw driver. Such a manually operable screw may be a thumb screw.

It is possible for the connection mechanism 40 to have alternative configurations using the concepts of the invention. One such alternative configuration includes a frictional engagement between the connection mechanism 40 and the second base portion 32. Similar to the embodiment discussed above, the connection mechanism 40 may have a U-shape.

While the figures illustrate the connection mechanism 40 being used in conjunction with a race track 12 having two lanes, it is possible to adapt the concepts for use in conjunction with race tracks having more than two lanes by using multiple connection mechanisms 40 to connection adjacent starting mechanisms 10.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A method of operating a race track on which toy race cars are raced, wherein the method comprises:

providing a first racing lane;

providing a second racing lane;

connecting a first activation mechanism to a first race car stop mechanism with a first start base;

connecting a second activation mechanism to a second race car stop mechanism with a second start base;

pivotally mounting the first race car stop mechanism to the first racing lane using the first start base so that the first race car stop mechanism is movable movement between a first stop position and a first start position, wherein when the first race car stop mechanism is in the first stop position, at least a portion of the first race car stop mechanism extends above the first upper surface;

pivotally mounting the second race car stop mechanism to the second racing lane using the second start base so that the second race car stop mechanism is movable movement between a second stop position and a second start position, wherein when the second race car stop mechanism is in the second stop position, at least a portion of the second race car stop mechanism extends above the second upper surface;

independently moving the first race car stop mechanism and the second race car stop mechanism from the first stop portion and the second stop position, respectively;

attaching a linking mechanism to the first start base and the second start base; and moving the first race car stop mechanism and the second race car stop mechanism in unison to the first stop position and the second stop position, respectively, when the linking mechanism is attached to the first start base and the second start base.

2. The method of claim 1, and further comprising mounting the first racing lane and the second racing lane in a substantially adjacent relationship.

3. The method of claim 1, wherein each of the first and second racing lanes each comprise a base surface and at least one divider that define the racing lane.

4. The method of claim 1, and further comprising mounting the first activation mechanism adjacent to a side of the first racing lane.

5. The method of claim 1, and further comprising attaching the linking mechanism to the first start base and the second start base with a fastening device.

6. The method of claim 1, wherein the linking mechanism frictionally engages the first start base and the second start base.

7. The method of claim 1, and further comprising preventing a race car from moving on the upper surface of the first racing lane past the first race car stop mechanism by positioning the first race car stop mechanism in a first stop position.

8. A method of operating a race track on which toy race cars are raced, wherein the method comprises:

providing a first racing lane;

providing a second racing lane;

connecting a first activation mechanism to a first race car stop mechanism with a first start base;

connecting a second activation mechanism to a second race car stop mechanism with a second start base;

pivotally mounting the first race car stop mechanism to the first racing lane using the first start base so that the first race car stop mechanism is movable movement between a first stop position and a first start position, wherein when the first race car stop mechanism is in the first stop position, at least a portion of the first race car stop mechanism extends above the first upper surface;

pivotally mounting the second race car stop mechanism to the second racing lane using the second start base so that the second race car stop mechanism is movable movement between a second stop position and a second start position, wherein when the second race car stop mechanism is in the second stop position, at least a portion of the second race car stop mechanism extends above the second upper surface;

independently moving the first race car stop mechanism and the second race car stop mechanism from the first stop portion and the second stop position, respectively;

attaching a linking mechanism to the first start base and the second start base; and indicating that the first race car stop mechanism is in the first stop position by orienting the first activation mechanism in a similar direction to the first race car stop mechanism when the first race car stop mechanism is in the first stop position.

9. A method of operating a race track on which toy race cars are raced, wherein the method comprises:

providing a first racing lane having an upper surface;

providing a second racing lane having an upper surface;

operably mounting a first starting mechanism to the first racing lane, wherein the first starting mechanism comprises a first activation mechanism and a first race car stop mechanism that is operably attached to the first activation mechanism;

operably mounting a second starting mechanism to the second racing lane, wherein the second starting mechanism comprises a second activation mechanism and a second race car stop mechanism that is operably attached to the second activation mechanism;

preventing a first race car from moving on the upper surface of the first racing lane past the first race car stop mechanism by positioning the first race car stop mechanism in a first stop position where the first race car stop mechanism extends above the upper surface of the first racing lane;

preventing a second race car from moving on the upper surface of the second racing lane past the second race car stop mechanism by positioning the second race car stop mechanism in a second stop position where the second race car stop mechanism extends above the upper surface of the second racing lane;

indicating that the first race car stop mechanism is in the first stop position by orienting the first activation mechanism in a similar direction to the first race car stop mechanism when the first race car stop mechanism is in the first stop position;

independently moving the first race car stop mechanism and the second race car stop mechanism from the first stop portion and the second stop position, respectively;

attaching a linking mechanism to the first starting mechanism and the second starting mechanism;

moving the first race car stop mechanism and the second race car stop mechanism in unison from the first stop position and the second stop position, respectively, when the linking mechanism is attached to the first starting mechanism and the second starting mechanism; and moving the first race car stop mechanism and the second race car stop mechanism in unison to the first stop position and the second stop position, respectively, when the linking mechanism is attached to the first starting mechanism and the second starting mechanism.

10. The method of claim 9, and further comprising moving the first race car stop mechanism and the second race car stop mechanism in unison to the first stop position and the second stop position, respectively, when the linking mechanism is attached to the first starting mechanism and the second starting mechanism.

11. The method of claim 9, and further comprising mounting the first activation mechanism adjacent to a side of the first racing lane.

12. The method of claim 9, and further comprising attaching the linking mechanism to the first starting mechanism and the second starting mechanism with a fastening device.

* * * * *